US010273886B2

(12) United States Patent
Shieh et al.

(10) Patent No.: US 10,273,886 B2
(45) Date of Patent: Apr. 30, 2019

(54) PROCESS FOR REDUCING ABNORMAL COMBUSTION WITHIN AN INTERNAL COMBUSTION ENGINE

(75) Inventors: Tenghua Tom Shieh, Ann Arbor, MI (US); Oana Nitulescu, Ann Arbor, MI (US); Wei Liu Liu, Canton, MI (US); Kiyotaka Yamashita, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 406 days.

(21) Appl. No.: 13/352,437

(22) Filed: Jan. 18, 2012

(65) Prior Publication Data

US 2013/0184974 A1 Jul. 18, 2013

(51) Int. Cl.

| | |
|---|---|
| ***F02D 35/02*** | (2006.01) |
| *F02D 41/24* | (2006.01) |
| *F02D 41/14* | (2006.01) |

(52) U.S. Cl.

CPC ..... *F02D 35/02* (2013.01); *F02D 35/024* (2013.01); *F02D 35/026* (2013.01); *F02D 41/1404* (2013.01); *F02D 41/1405* (2013.01); *F02D 41/1458* (2013.01); *F02D 41/2454* (2013.01); *F02D 2041/1433* (2013.01); *F02D 2041/1437* (2013.01)

(58) Field of Classification Search

CPC ..... F02D 41/1405; F02D 41/1404; F02D 2041/1433; F02D 41/2454; F02D 41/1458

See application file for complete search history.

(56) References Cited

U.S. PATENT DOCUMENTS 5,313,826 A 5/1994 Klauber et al.
5,603,290 A * 2/1997 Swain et al. ..... 123/41.86
(Continued)

FOREIGN PATENT DOCUMENTS

JP 58091370 A 5/1983

OTHER PUBLICATIONS

Jia, Ke, A Coupled Model for Ring Dynamics, Gas Flow, and Oil Flow Through the Ring Grooves in IC Engines, Jan. 2009, Massachusetts Institute of Technology. <http://hdl.handle.net/1721.1/46383>, Date Accessed: Apr. 23, 2014.*
(Continued)

*Primary Examiner* — Lindsay M Low
*Assistant Examiner* — Joshua Campbell
(74) *Attorney, Agent, or Firm* — Dinsmore & Shohl LLP

(57) ABSTRACT

The present invention provides a process for reducing abnormal combustion within a combustion chamber of the engine. The process can include simulation of the piston-driven internal combustion engine with oil droplets from the crankcase entering into the combustion chamber. In addition, the oil drops entering into the combustion chamber can be simulated as hot spots, as can simulation of fuel combustion within the combustion chamber. A probability of pre-ignition for at least a portion of the simulated hot spots as a function of the simulated fuel combustion and the simulated hot spots within the combustion chamber can be calculated and based on the calculation a combustion chamber parameter can be altered such that pre-ignition within the combustion chamber is reduced.

18 Claims, 8 Drawing Sheets

(56) References Cited

U.S. PATENT DOCUMENTS

| | | | | |
|---|---|---|---|---|
| 5,771,181 | A * | 6/1998 | Moore | B25J 9/1689 318/568.1 |
| 6,058,906 | A * | 5/2000 | Yoshino | 123/295 |
| 6,178,373 | B1 | 1/2001 | Davis et al. | |
| 6,397,669 | B1 | 6/2002 | Raichle et al. | |
| 6,401,058 | B1 * | 6/2002 | Akalin | G01M 13/005 702/34 |
| 7,004,119 | B2 * | 2/2006 | Dardalis | 123/43 R |
| 7,017,399 | B2 | 3/2006 | Yokohata et al. | |
| 7,343,273 | B2 * | 3/2008 | Kusunoki | G06F 17/5095 703/6 |
| 2004/0128011 | A1 * | 7/2004 | Kusunoki | G06F 17/5095 700/98 |
| 2006/0037577 | A1 * | 2/2006 | Procknow | 123/193.5 |
| 2007/0106477 | A1 * | 5/2007 | Gruter | G01N 33/30 702/19 |
| 2008/0016849 | A1 * | 1/2008 | McCarthy | F01N 3/0253 60/286 |
| 2009/0139237 | A1 * | 6/2009 | Sullivan et al. | 60/737 |
| 2010/0077992 | A1 * | 4/2010 | Auclair | F02D 19/12 123/435 |
| 2013/0184974 | A1 * | 7/2013 | Shieh | F02D 35/02 701/106 |
| 2013/0334254 | A1 * | 12/2013 | Rose | 222/175 |

OTHER PUBLICATIONS

Dahnz, C. Irregular combustion in supercharged spark ignition engines—pre-ignition and other phenomena, Dec. 2010, International Journal of Engine Research, vol. 11. <http://jer.sagepub.com/content/11/6/485>, Date Accessed: Apr. 23, 2014.*

Chen, J. Direct numerical simulation of ignition front propagation in a constant volume with temperature inhomogeneities, Jan. 2006, Combustion and Flame, vol. 45.*

* cited by examiner

PROCESS FOR REDUCING ABNORMAL COMBUSTION WITHIN AN INTERNAL COMBUSTION ENGINE

FIELD OF THE INVENTION

The present invention is related to a process for reducing abnormal combustion within a combustion chamber of an internal combustion engine.

BACKGROUND OF THE INVENTION

The use of internal combustion engines to generate power is known. In addition, piston-driven internal combustion engines are commonly used in motor vehicles, tractors, lawnmowers, and the like. Such piston-driven internal combustion engines typically have a cylinder, a piston with at least one piston ring, a head, and the like. Fuel is injected into a combustion chamber that is present between the piston, cylinder, and head. The fuel can be mixed with air and combustion of the fuel plus air mixture can provide a rapid expansion within the combustion chamber that drives the piston in a downward or outward direction and results in the rotation of a crankshaft and the production of mechanical power.

Abnormal combustion within the combustion chamber, for example pre-ignition within the combustion chamber is also known to occur and can result from oil deposits on the piston head, cylinder side wall, the head, and the like. The oil, originally present in a crankcase of the internal combustion engine, enters into the combustion chamber by passing from the crankcase, past the at least one piston ring, and into the chamber. The oil can be in the form of droplets, that when deposited onto surfaces within the combustion chamber result in reduced heat transfer and creation of one or more hot spots. Hot spots can also be the result of soot within the combustion chamber, the soot forming from incomplete combustion of oil droplets and/or fuel. The hot spots can then serve as pre-ignition sites with pre-ignition of fuel in the combustion chamber resulting in decreased performance, damage to a piston and/or an increase in fuel use by the engine. Therefore, a process for reducing abnormal combustion within the combustion chamber would be desirable.

SUMMARY OF THE INVENTION

The present invention provides a process for reducing abnormal combustion within a combustion chamber of a piston-driven internal combustion engine. The process can include providing a piston-driven internal combustion engine, the engine having at least one cylinder, a piston with at least one piston ring, a head, a crankcase, a crankshaft, and other components typically found in an internal combustion engine and known to those skilled in the art.

Simulation of the piston-driven internal combustion engine can provide for oil droplets from the crankcase passing past the at least one piston ring and entering into the combustion chamber to be modeled. In addition, the oil drops entering into the combustion chamber can be simulated as hot spots, as can simulation of fuel plus air combusting within the combustion chamber.

A probability of pre-ignition for at least a portion of the simulated hot spots as a function of the simulated fuel plus air combustion and the simulated hot spots within the combustion chamber can be calculated, and based on the calculation, a combustion chamber parameter can be altered such that pre-ignition within the combustion chamber is reduced. Stated differently, simulation of oil drops entering into the combustion chamber in combination with fuel plus air combustion allow for the probability of pre-ignition within the combustion chamber to be calculated. Based on the calculation, the combustion chamber of the internal combustion engine can be altered such that the probability of pre-ignition is reduced, the reduction in pre-ignition providing improved engine performance.

The simulation of the oil droplets passing past the at least one piston ring and entering into the combustion chamber can include simulation of a quantity of the oil and/or initial flow conditions for the oil entering into the combustion chamber. In some instances, a ring dynamics model can be used for the simulation of the quantity of oil entering the combustion chamber. In addition, oil droplets being present in a crevice between the piston and cylinder, and the oil droplets escaping from the crevice and entering into the combustion chamber, can be simulated. The simulation can also model or predict oil droplets depositing onto a combustion chamber surface such as a surface of the head, a valve head surface, a piston head surface, and the like.

Simulating combustion of fuel and air within the combustion chamber can be a function of pressure within the combustion chamber, temperature within the combustion chamber, equivalence ratio in the combustion chamber, properties of the fuel in the combustion chamber, and the like. The pressure, temperature, and equivalence ratio in the combustion chamber can be a plurality of pressures, a plurality of temperatures, and a plurality of equivalence ratios as a function of location within the combustion chamber. In addition, altering the combustion chamber parameter can include altering the cylinder, piston, at least one piston ring, head, etc.

DETAILED DESCRIPTION OF THE INVENTION

The present invention provides a process for reducing abnormal combustion within a piston-driven combustion chamber. As such, the present invention has utility for improving engine performance of a motor vehicle.

The process can include providing a piston-driven internal combustion engine. The engine can include a cylinder, a piston with at least one piston ring, a head with an intake and outtake, a crankcase with a crankshaft, the crankcase rotatably connected to the piston as known to those skilled in the art, and with the piston and head forming a combustion chamber as is also known to those skilled in the art. The head can also include one or more valves with valve seats and a spark plug.

One or more components of the internal combustion engine can be simulated, as can oil passing from the crankcase, past the at least one piston ring and entering into the combustion chamber. In addition, oil droplets entering into the combustion chamber can be simulated as hot spots deposited onto a surface of the combustion chamber and/or hot spots not on a surface but within a free volume of the combustion chamber. Combustion of a fuel and air mixture within the combustion chamber can also be simulated and a probability of pre-ignition at one or more of the hot spots can be calculated as a function of the simulated air plus fuel combustion and simulated hot spots.

Locations within the combustion chamber that have a high probability of pre-ignition can be identified and a combustion chamber parameter can be altered in order to reduce the probability of pre-ignition within the engine. It is appreciated that the reduction of pre-ignition within the engine can result in greater efficiency thereof, prevent piston damage and the like.

A quantity of oil and/or initial flow conditions for the oil entering into the combustion chamber can be simulated using a ring dynamics model, as can the oil in the form of oil droplets. In addition, the oil droplets can be simulated as being located in a crevice between the piston and cylinder before escaping into the combustion chamber. In some instances, oil droplets can be simulated as depositing onto a combustion chamber surface and/or being located within the free volume of the combustion chamber and not located on a surface.

Regarding simulation of the fuel plus air combustion within the combustion chamber, the simulation can be a function of load, revolutions per minute (RPM) and the like for the engine. In addition, the simulation can provide a pressure within the chamber, one or more temperatures within the chamber, one or more equivalence ratios within the chamber, and the like. Based on one or more locations where a relatively high probability of pre-ignition occurs, the combustion chamber parameter that is altered can be shape, size, and/or material of the cylinder, piston, the at least one piston ring, the head, and the like.

Figure 1:
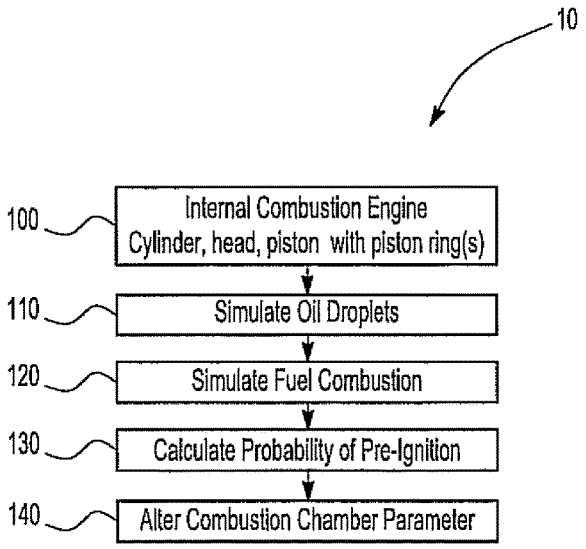
FIG. 1 is a schematic illustration of a process according to an embodiment of the present invention.

Turning now to FIG. 1, a schematic illustration of a process according to an embodiment of the present invention is shown generally at reference numeral 10. The process 10 includes providing an internal combustion engine at step 100, simulating oil droplets within the internal combustion engine at step 110—for example oil droplets within a combustion chamber of the engine—and simulation of fuel combustion with the engine at step 120. Thereafter, a probability of pre-ignition within the internal combustion engine is calculated at step 130 and a combustion chamber parameter is altered at step 140.

Figure 2:
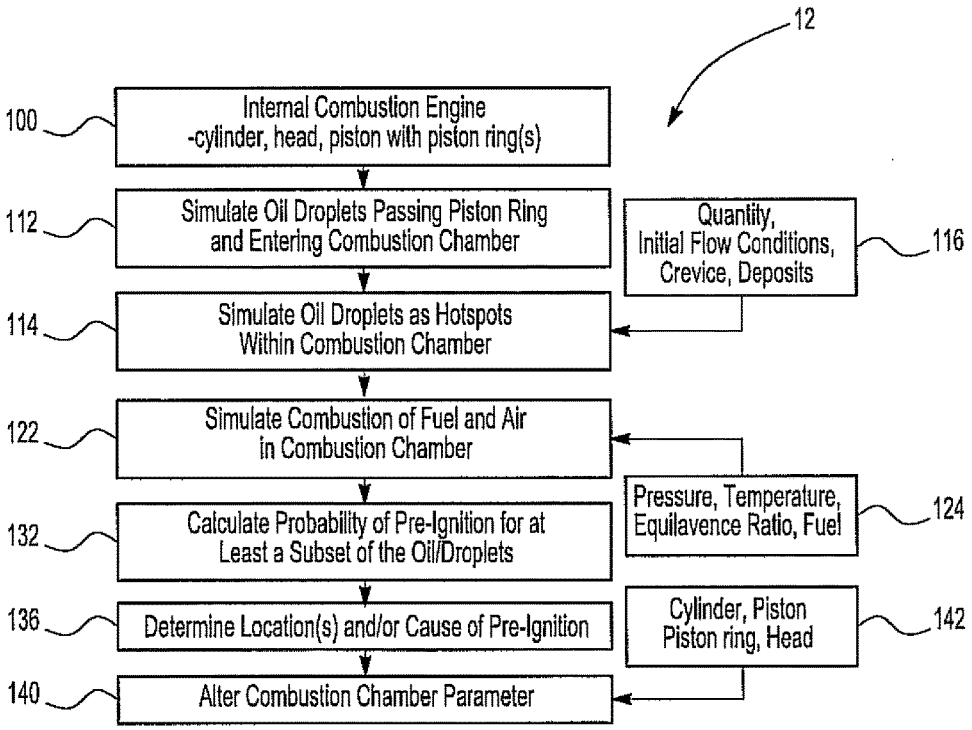
FIG. 2 is a schematic illustration of a process according to an embodiment of the present invention.

Another embodiment of a process is shown generally at reference numeral 12 in FIG. 2. The process 12 also includes providing the internal combustion engine at step 100 followed by simulation of oil droplets passing past a piston ring and entering the combustion chamber at step 112. The oil drops are simulated as hot spots within the combustion chamber at step 114 and parameters such as quantity of oil, initial flow conditions, a crevice between the piston and cylinder and/or oil deposits within the combustion chamber as shown at reference numeral 116 can be provided and/or simulated. Combustion of fuel and air within the combustion chamber can be simulated at step 122 with parameters such as pressure, temperature, equivalence ratio, fuel properties, and the like provided and/or simulated as illustrated at reference numeral 124.

The process also includes calculation of a probability of pre-ignition for at least a subset of the oil droplets/hot spots at step 132 which can afford for determination of one or more locations and/or causes of pre-ignition within the combustion chamber at step 136. Based on the results from step 132 and/or step 136, a combustion chamber parameter can be altered at step 140, the parameter including the size, shape, material, and the like of the cylinder, piston, piston ring, head, etc. as illustrated at reference numeral 142.

In order to better illustrate the teachings of the present invention, and yet not limit the scope in any way, one or more examples of the process is described below.

Figure 3:
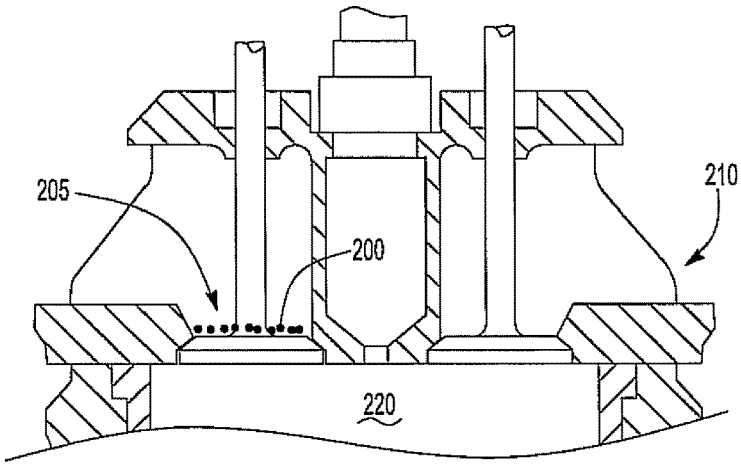
FIG. 3 is a schematic illustration of a head and cylinder for an internal combustion engine with gas droplets simulated at an intake location.
Figure 4:
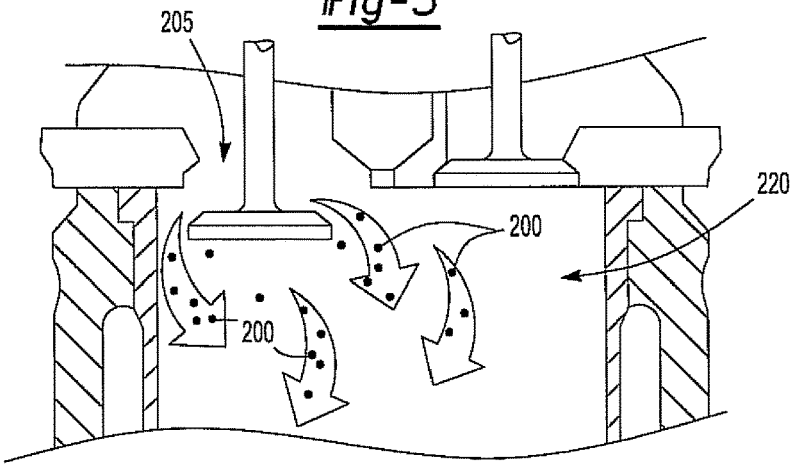
FIG. 4 is a schematic illustration of the head and cylinder shown in FIG. 3 after the gas droplets have been simulated to be entering the combustion chamber of the internal combustion engine.
Figure 5:
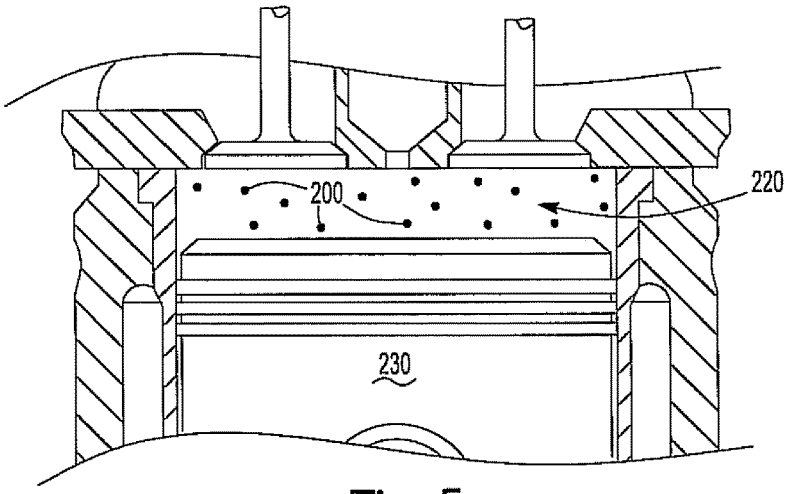
FIG. 5 is a schematic illustration of the head and cylinder shown in FIG. 3 after the gas droplets have been simulated to be released into the combustion chamber of the internal combustion engine.

Referring now to FIG. 3, the process can simulate gas droplets 200 within a head intake valve region 205 of a head 210 before being released into a combustion chamber 220 for an internal combustion engine. In addition, FIG. 4 illustrates the gas droplets 200 from FIG. 3 being released into the combustion chamber 220 and FIG. 5 illustrates the droplets 200 after being released in the chamber 220, the intake valve region 205 being closed and a piston 230 compressing the gas. It is appreciated that the simulation can be performed using any known simulation program, software, etc. known to those skilled in the art.

Figure 6:
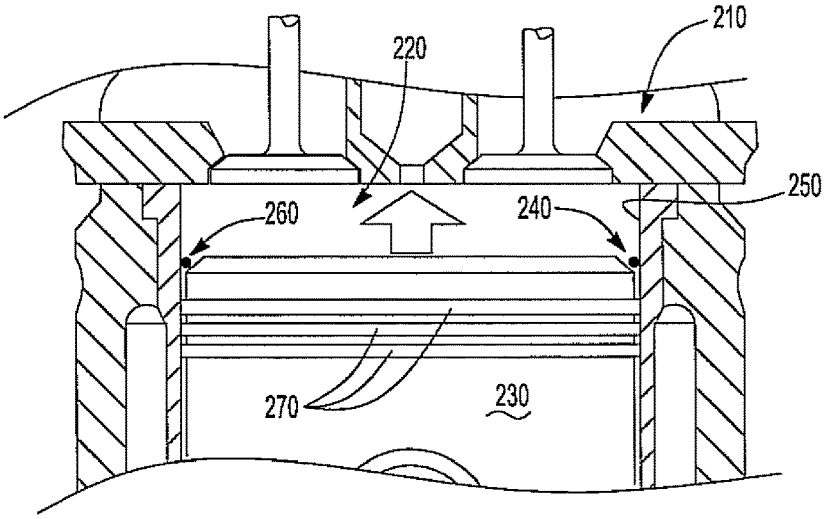
FIG. 6 is a schematic illustration of a crevice between a piston and cylinder for an internal combustion engine with oil droplets simulated being present in the crevice.
Figure 7:
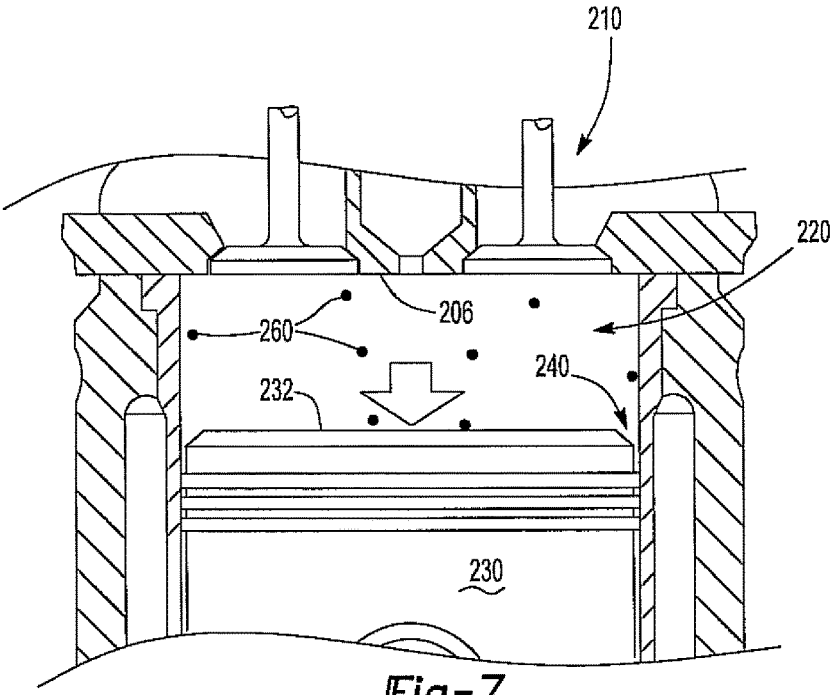
FIG. 7 is a schematic illustration of the combustion chamber shown in FIG. 6 after the oil droplets have been simulated to be released into the combustion chamber.

Oil droplets can also be simulated before and after entering into the combustion chamber as illustrated in FIGS. 6 and 7. In particular, FIG. 6 illustrates that the simulation can include a crevice 240 between the piston 230 and a cylinder sidewall 250 with oil droplets 260 that have passed past one or more piston rings 270 being accumulated within the crevice 240 before release into the combustion chamber 220. In addition, the quantity of oil present within the crevice 240 and initial flow conditions of the oil droplets 260 upon entering the combustion chamber 220 can be simulated, as can the location of the oil droplets 260 after being released into the chamber 220 as illustratively shown in FIG. 7.

In some instances, all of the oil droplets 260 can be simulated to be on a surface of the combustion chamber 220, e.g. on a piston head surface 242, cylinder sidewall surface 250, and/or head surface 206. In the alternative, the oil droplets 260 can be simulated to be on a surface and within a free volume of the combustion chamber 220. The oil droplets 260 can also be simulated as a hot spot, that is, as a heat source.

Figure 8:
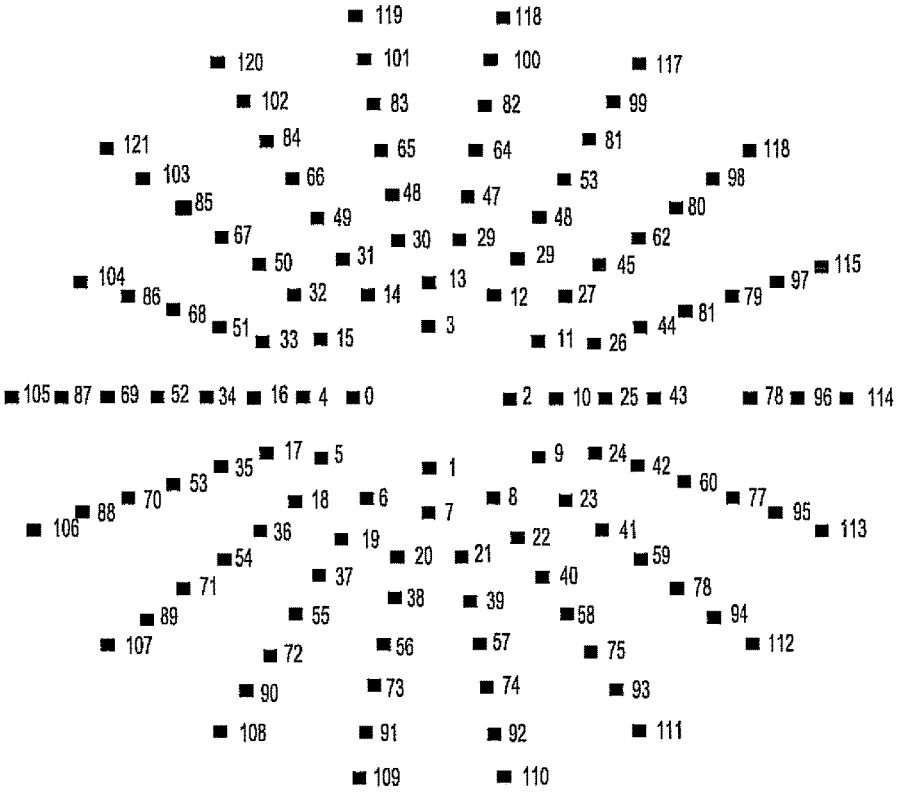
FIG. 8 is a schematic illustration of a simulation grid for a head and/or piston of an internal combustion engine.

Turning now to FIG. 8, an array or grid of heat sources placed in the combustion chamber, e.g. on a piston head, is shown. It is appreciated that the heat sources can be used to simulate oil droplets, soot and the like.

Figure 9:
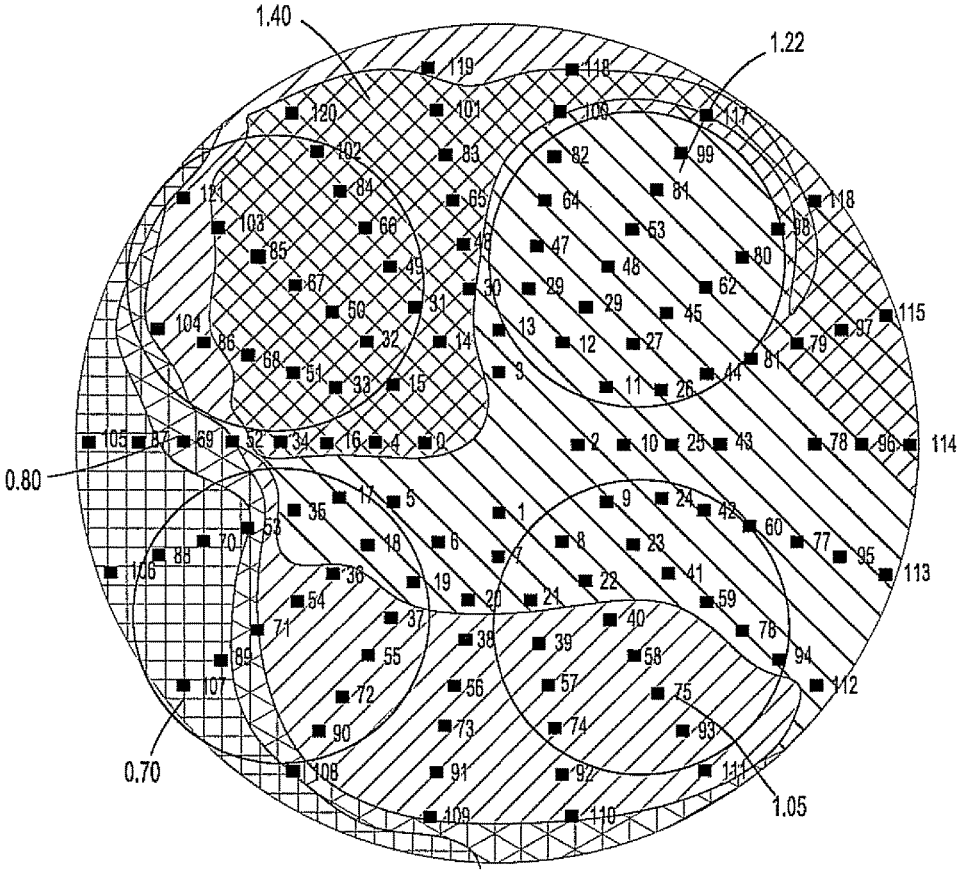
FIG. 9 is the result of an equivalence ratio simulation for a combustion chamber of an internal combustion engine at a crank angle of −31 degrees with crass-hatched regions illustrating areas of the head and/or piston having generally uniform equivalence ratios.
Figure 10:
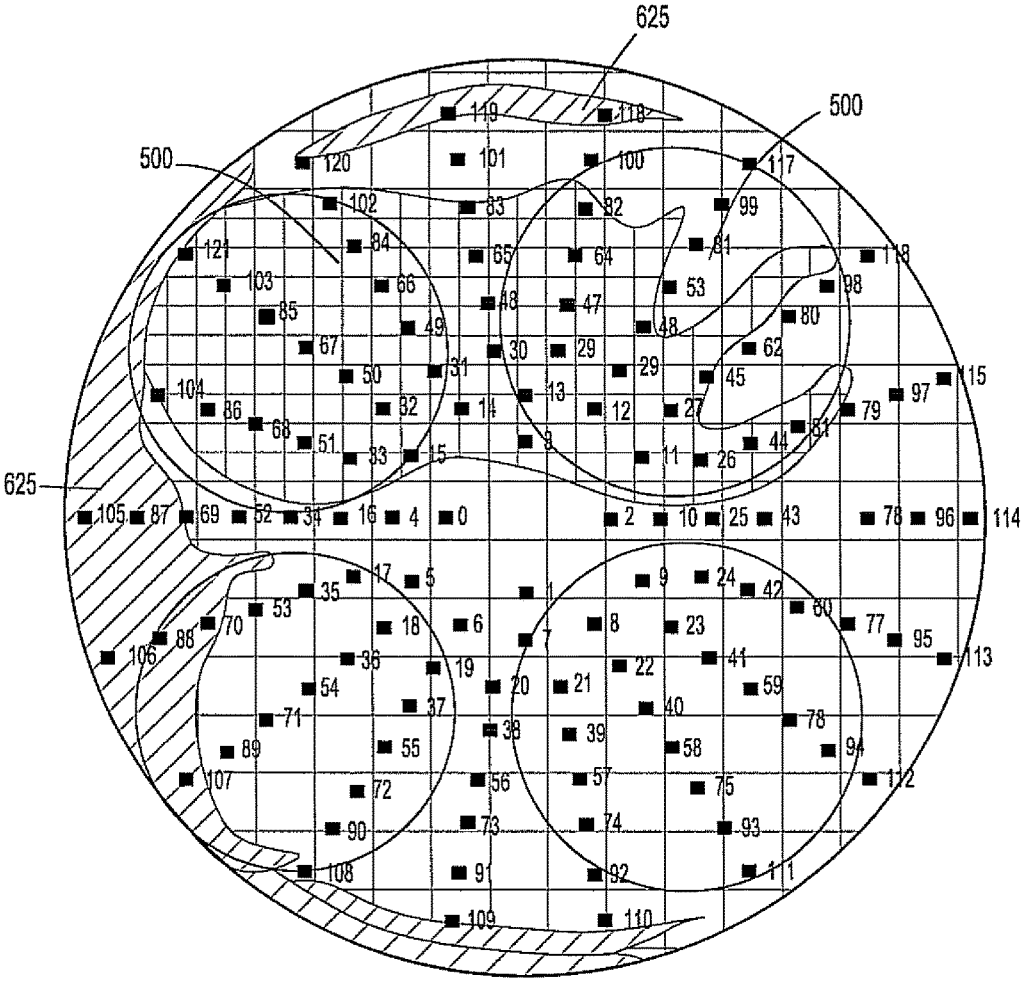
FIG. 10 is the result of a temperature simulation for a combustion chamber of an internal combustion engine at a crank angle of −31 degrees with cross-hatched regions illustrating areas of the head and/or piston having generally uniform temperatures.
Figure 11:
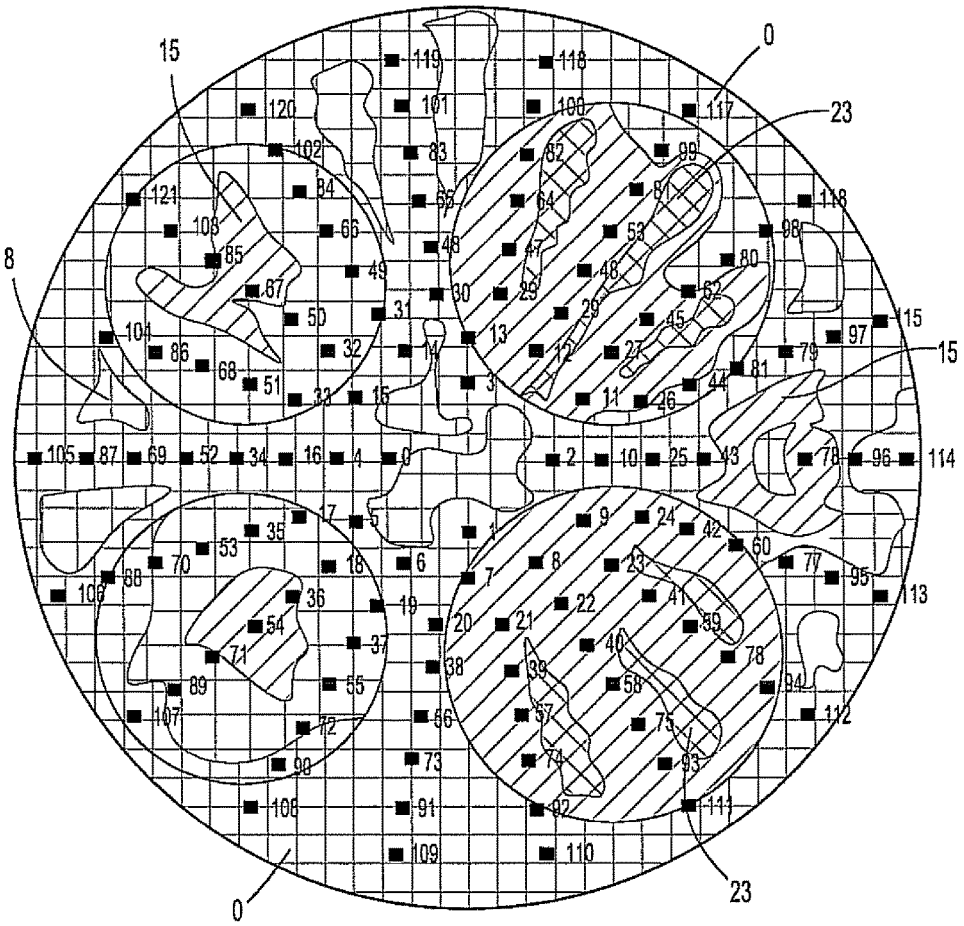
FIG. 11 is the result of a turbulence simulation for a combustion chamber of an internal combustion engine at a crank angle of −31 degrees with cross-hatched regions illustrating areas of the head and/or piston having generally uniform turbulences.
Figure 12:
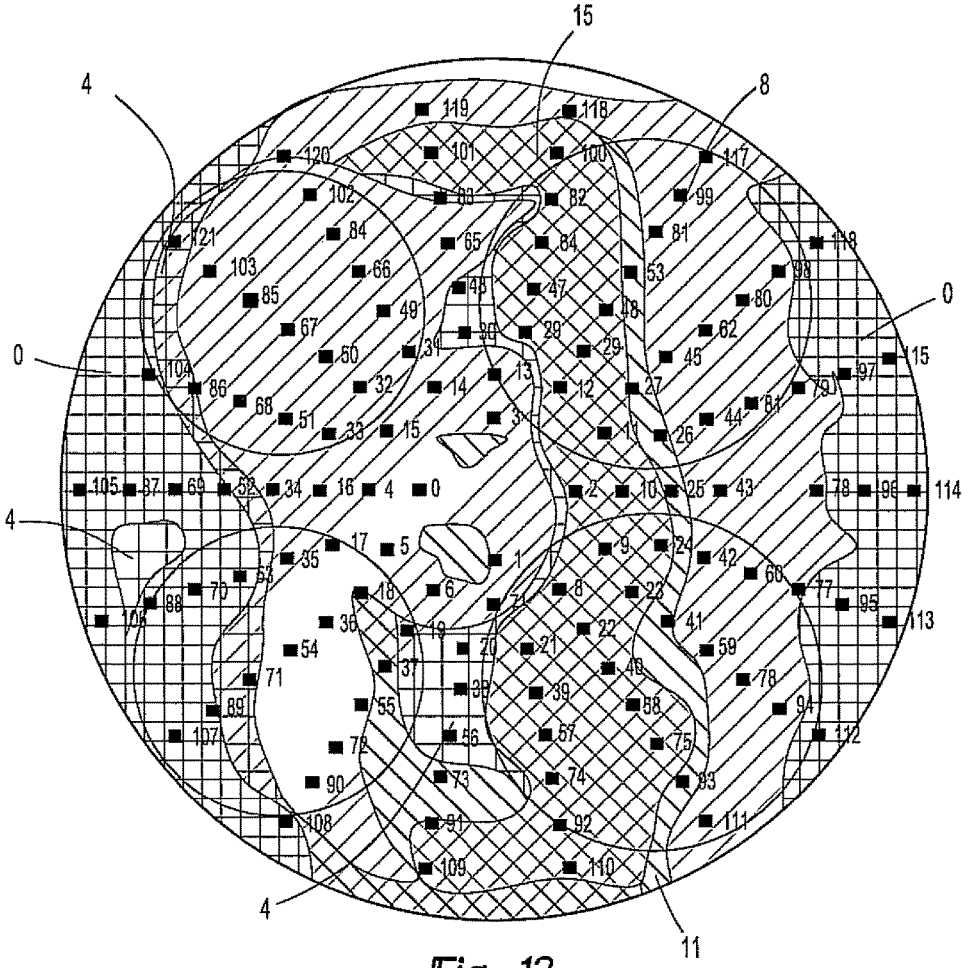
FIG. 12 is the result of a velocity simulation for a combustion chamber of an internal combustion engine at a crank angle of −31 degrees with cross-hatched regions illustrating areas of the head and/or piston having generally uniform velocities.

FIG. 9 illustrates a simulated equivalence ratio as a function of location within the combustion chamber and a crank angle for the piston at −31 degrees with the different cross-hatched regions illustrating areas of the head and/or piston having generally uniform equivalence ratios of 0.70, 0.80, etc. shown in the figure. Similarly, FIGS. 10-12 provide simulations of temperature, turbulence, and velocity, respectively.

Based on the simulation results, conditions favoring pre-ignition at one or more oil droplets within the combustion chamber and/or one or more locations shown on the grid in FIG. 8 can be determined. For example, simulation results shown in FIGS. 9-12 determined the two locations 108 and 109 in FIG. 8 to have a relatively high probability of pre-ignition. In order to confirm the simulated results, a transducer was attached to the head of the internal combustion engine that was being modeled the predicted pre-ignition location(s) as and used to measure pressure wave values as a function of crank angle during operation of the engine.

Figure 13:
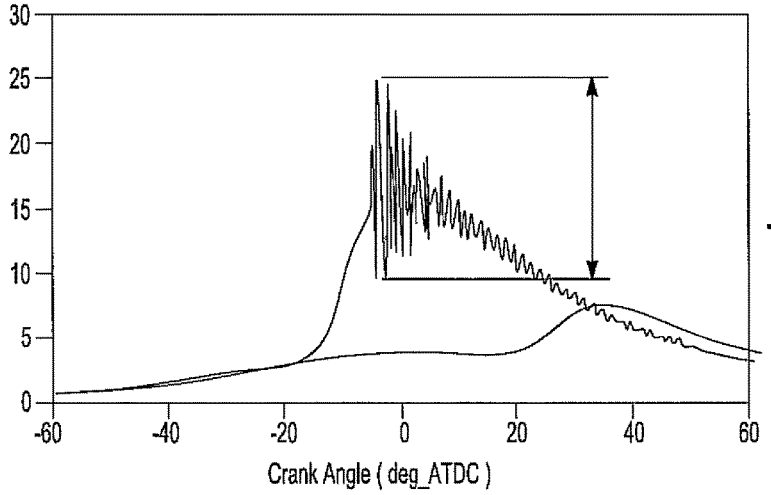
FIG. 13 is a graphical plot of pressure versus crank angle for a combustion chamber of an internal combustion engine.

FIG. 13 illustrates a graph of pressure versus crank for the combustion chamber with the base spark timing for the engine was −4 degrees before top dead center (BTDC). In this manner, testing of the internal combustion engine confirmed the accuracy of the simulation results and affords for altering of the combustion chamber in order to reduce the probability of pre-ignition at the two locations and/or conduct additional simulations to determine the effect of changing the combustion chamber parameters.

In some instances, one or more statistical treatments can be used to decrease computation time and thus save the cost of performing the inventive process disclosed herein. For example, rather than establishing, setting and/or calculating a heat source at each grid point or grid area shown in FIG. 8, ignition delay can be calculated for a range of typical engine conditions and a correlation between ignition delay and pressure, temperature and/or equivalence ratio within the combustion chamber can be determined: Ignition Delay=f(pressure, temperature, equivalence ratio). In addition, a threshold for pre-ignition can be determined, e.g. if Ignition Delay<x milliseconds, then conditions favorable for pre-ignition, and modeled combustion chamber regions that exhibit ignition delay less than the threshold can be seeded with heat sources. Stated differently, a global pre-ignition index that estimates a pre-ignition tendency can be defined with heat sources placed within the regions meeting a given criterion with respect to the index. In this manner, modeling of heat sources for the entire grid does not have to be executed.

It is appreciated that the simulations, calculations, etc., can be extremely complex and thus electronic equipment such as a computer with memory, one or more processing units, look-up tables and the like can be required to perform the simulations, calculations, etc.

In view of the teaching presented herein, it is to be understood that numerous modifications and variations of the present invention will be readily apparent to those of skill in the art. As such, the foregoing is illustrative of specific embodiments and/or examples of the invention but is not meant to be a limitation upon the practice thereof. It is the following claims, including all equivalents, which define the scope of the invention.

We claim:

1. A process reducing abnormal combustion within a combustion chamber of an engine, the process comprising:

providing a piston-driven internal combustion engine having a cylinder, a piston with at least one piston ring and a head using a computer, the cylinder, piston and head forming a combustion chamber;

providing the computer with memory and a processing unit, the computer operable to perform simulations and calculations;

simulating at least one of the cylinder, the piston with at least one piston ring and the head of the piston-driven internal combustion engine using the computer;

simulating oil droplets passing past the at least one piston ring and entering into the combustion chamber using the computer;

simulating the location of the oil droplets within the combustion chamber after entering into the combustion chamber using the computer;

determining hot spots in the combustion chamber from the oil droplets simulation and from the location of the oil droplets simulation using the computer;

simulating combustion of fuel and air within the combustion chamber including simulation of fuel properties using the computer;

calculating a probability of pre-ignition for at least a portion of the hot spots in the combustion chamber as a function of the simulated combustion and determined hot spots within the combustion chamber using the computer; and altering a combustion chamber parameter of the piston-driven internal combustion engine as a function of the determined probability of pre-ignition, the changing of combustion chamber parameter reducing pre-ignition for the piston-driven internal combustion engine.

2. The process of claim 1, wherein simulating oil droplets passing past the at least one piston ring and entering into the combustion chamber includes simulating an amount of oil and initial flow conditions for the oil droplets using a ring dynamics model.

3. The process of claim 2, wherein simulating oil entering into the combustion chamber includes simulating the oil droplets in a crevice between the piston and cylinder escaping the crevice and entering into the combustion chamber.

4. The process of claim 3, wherein simulating oil entering into the combustion zone includes the oil droplets depositing onto a combustion chamber surface.

5. The process of claim 1, wherein simulating combustion of fuel and air within the combustion chamber is a function of at least one of pressure in the combustion chamber, temperature in the combustion chamber, equivalence ratio in the combustion chamber and fuel properties.

6. The process of claim 5, wherein temperature and equivalence ratio in the combustion chamber is a plurality of temperatures and a plurality of equivalence ratios, respectively, in the combustion chamber.

7. The process of claim 1, wherein altering the combustion chamber parameter includes altering at least one of the cylinder, piston, at least one piston ring and head.

8. The process of claim 1, further including the piston-driven internal combustion engine having a head intake valve region, simulating oil droplets within the head intake valve region before being released into the combustion chamber and simulating the oil droplets after being released into the combustion chamber using the computer.

9. The process of claim 1, further including simulating equivalence ratios of the simulated combusted fuel plus air as a function of location in the combustion chamber using the computer.

10. The process of claim 9, wherein the function of location in the combustion chamber is a function of location on a piston head.

11. The process of claim 10, further including simulating temperatures of the simulated combusted fuel plus air as a function of location in the combustion chamber.

12. The process of claim 11, wherein the function of location in the combustion chamber is a function of location on a piston head.

13. The process of claim 11, further including simulating turbulence of the simulated combusted fuel plus air as a function of location in the combustion chamber.

14. The process of claim 13, wherein the function of location in the combustion chamber is a function of location on a piston head.

15. The process of claim 13, further including simulating velocity of the simulated combusted fuel plus air as a function of location in the combustion chamber.

16. The process of claim 15, wherein the function of location in the combustion chamber is a function of location on a piston head.

17. The process of claim 15, wherein calculation of the probability of pre-ignition is a function of the simulated equivalence ratio, temperature, turbulence and velocity as a function of location in the combustion chamber.

18. The process of claim 17, wherein the function of location in the combustion chamber is a function of location on a piston head.

* * * * *